US005813151A

United States Patent [19]

Stephens et al.

[11] Patent Number: 5,813,151

[45] Date of Patent: Sep. 29, 1998

[54] TRENCHING OR CUTTING APPARATUS

[76] Inventors: Anthony Leon Stephens, 3511 Pacific Highway, Springwood, Queensland, 4217; Barry James Ketter, 2 Dorothy Street, Woodridge, Queensland 4114, both of Australia

[21] Appl. No.: 748,350

[22] Filed: Nov. 14, 1996

[51] Int. Cl.[6] ..... E02D 5/20

[52] U.S. Cl. ..... 37/352; 37/403

[58] Field of Search ..... 37/187, 352, 353, 37/355, 362, 403, 443, 465, 464, 193; 405/267

[56] References Cited

U.S. PATENT DOCUMENTS

| | | | |
|---|---|---|---|
| 3,266,179 | 8/1966 | Golden | 37/355 |
| 3,309,802 | 3/1967 | Baker | 37/352 |
| 4,906,161 | 3/1990 | Weyer | 37/403 X |
| 5,140,760 | 8/1992 | Mannbro | 37/403 X |
| 5,247,743 | 9/1993 | Holloway et al. | 37/355 |
| 5,592,761 | 1/1997 | Ward | 37/403 |

*Primary Examiner*—Terry Lee Melius
*Assistant Examiner*—Robert Pezzuto
*Attorney, Agent, or Firm*—Helfgott & Karas, P.C.

[57] ABSTRACT

An excavator assembly 10 including an excavator body having a pair of tracks 12 an 13, a cab 14, an articulated boom 15 and a trenching or cutting attachment 16 mounted at the end of the boom 15. The trenching or cutting attachment comprises a blade 17 mounted to a box-like drive mounting 18 with the box-like mounting 18 having on an opposite side thereof an excavator mounting 19 element so that the attachment can be detached from the excavator. A swivel arrangement is provided for swivelling the blade 17. The excavator mounting is a standard hoe bucket fitting.

9 Claims, 10 Drawing Sheets

TRENCHING OR CUTTING APPARATUS

BACKGROUND OF THE INVENTION

1. Field of the Invention

THIS INVENTION relates to a trenching or cutting apparatus and particularly to a trencher or cutter attachment for an excavator and more particularly to an excavator assembly configured as a trenching or cutting apparatus.

2. Description of the Prior Art

Present trenching or cutting apparatus are dedicated machines. These machines are expensive to buy and expensive to maintain. In addition present dedicated machines lack flexibility. When there is no trenching or cutting work to be done large and expensive machines stand idle.

It is an object of the present invention to alleviate at least to some degree the abovementioned deficiencies of the prior art.

SUMMARY OF THE INVENTION

In one aspect therefore the present invention resides in a trenching or cutting attachment for an excavator, the attachment having an excavator mounting means at a proximal end thereof, a drive mounting, a drive assembly coupled to the drive mounting, an elongate blade having a peripheral edge and a cutting or digging chain travelling around the peripheral edge of the blade, the blade having an idler wheel at a distal end thereof opposite the drive assembly and the chain travelling around the idler wheel.

Preferably the excavator mounting means or the drive mounting employ a swivel mounting so that the blade can swivel about its longitudinal axis. Typically, a double acting hydraulic cylinder assembly is employed to selectively swivel the blade through 90 degrees.

The excavator mounting means is preferably a standard hoe bucket fitting having secured thereto at an opposite side thereof the drive mounting, the drive mounting being typically configured as a pair of opposed projecting plates forming spaced flanges so that the excavator mounting means and drive mounting means form an open box-like structure, the box-like structure having an hydraulic motor mounted on an outside of one of said plates, a drive shaft extending between the opposed plates and being journalled in bearings in each plate, the drive shaft carrying a sprocket wheel located between the plates to drive the chain, the drive mounting having the blade rigidly secured thereto and projecting longitudinally therefrom and in line with the swivel mounting.

The attachment can be secured to a machine configured as the equivalent of an excavator slew base or the attachment can be secured to the excavator boom or to a part of the boom.

In another preferred aspect therefore the invention resides in an excavator assembly configured as a trenching or cutting apparatus comprising an excavator slew body and a trenching or cutting attachment coupled to the slew body either directly or indirectly via an articulated boom or part thereof, the attachment having an excavator mounting means at a proximal end thereof, a drive mounting, a drive assembly coupled to the drive mounting, an elongate blade having a peripheral edge and a cutting or digging chain travelling around the peripheral edge of the blade, the blade having an idler wheel at a distal end thereof opposite the drive assembly and the chain travelling around the idler wheel.

Typically the trenching or cutting attachment is a trenching or cutting attachment as described above.

The excavator assembly typically employs an excavator body and boom suitable for the particular digging or cutting application. The invention can be employed for cutting narrow or wide cuts with application for cutting, for example, cutting marble or the invention may be used for trenching in pipe laying, conduit and cable laying to name a few non-limiting examples. For instance, in the case of sandstone it is preferable to utilise self cleaning rotating cone teeth and the excavator on a 120 mm wide chain and in order to cater for the reaction force when the attachment is being used it is preferable to utilise an excavator of between 25 ton to 40 ton in capacity and most preferably about 25 ton as a minimum for cutting sandstone or the like. The invention can be employed on mini-excavator or largest available excavators. There is no limit.

The blade and chain can be selected according to a particular application and in the case of sandstone the blade is typically 3 m to 4 m long.

The excavator body and boom typically operate according to normal processes and are configured so that the blade is articulated by the boom for the full range of movements customarily present in an excavator during back hoe and the like operations although a dedicated excavator having a shorter boom can be employed.

This operation typically involves extending the blade from a projecting generally horizontal extension to a retracted tucked away transport position opposite the extended position and as a consequence of the swivel mount there also exists the possibility of swivelling the blade through up to 90 degrees. In addition the excavator body can also rotate about a vertical axis up to 360 degrees. Thus the blade can be not only held horizontally but can be held vertically down from the excavator and in the same position swivelled about a vertical axis. It thus therefore provides the capability for under cutting and cutting out quadrilateral or triangular shapes without changing the actual position of the excavator.

DESCRIPTION OF THE DRAWINGS

In order that the present invention can be more readily understood and be put into practical effect reference will now be made to the accompanying drawings which illustrate a preferred embodiment of the invention and wherein.

DESCRIPTION OF THE PREFERRED EMBODIMENTS

Figure 1:
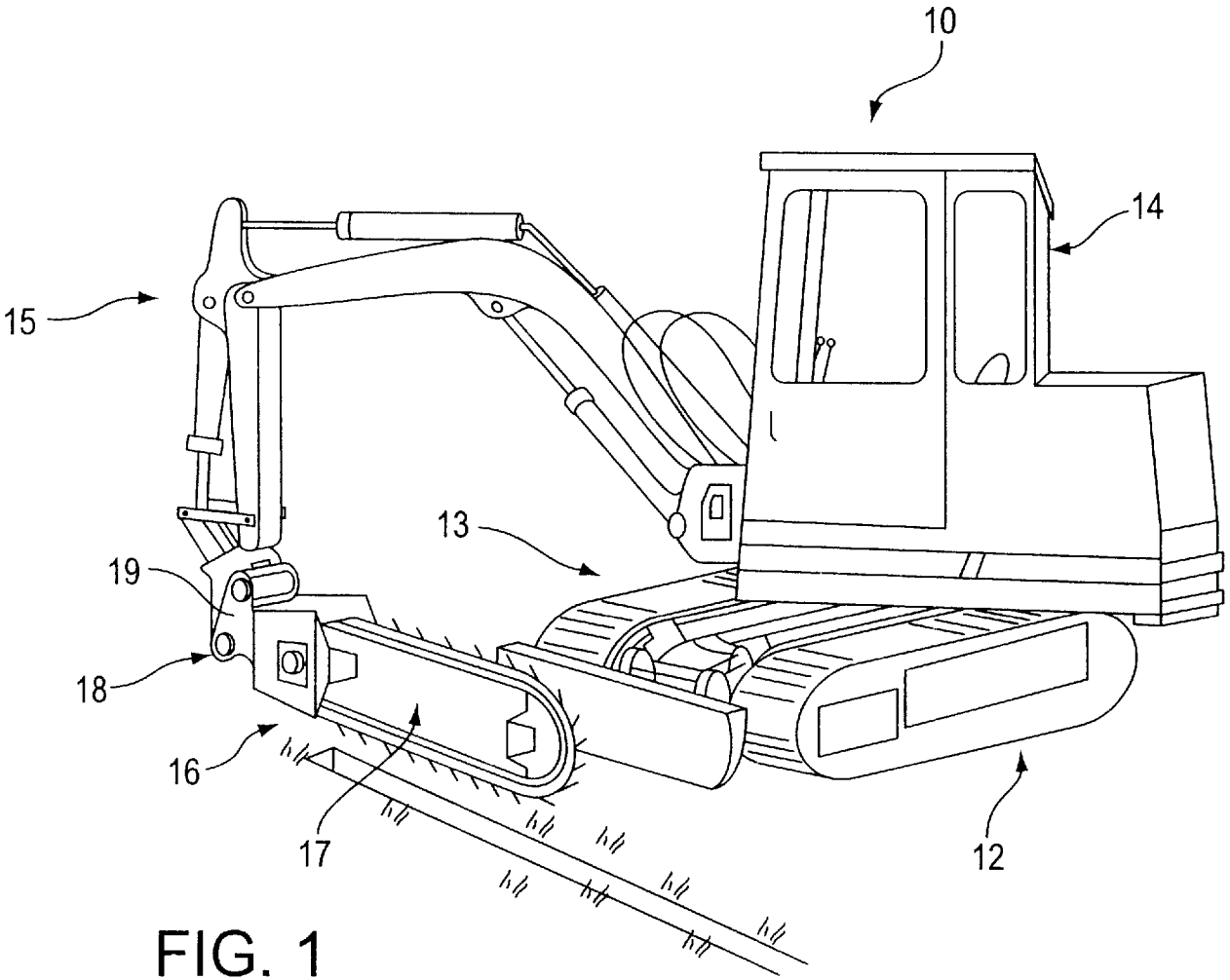
FIG. 1 is a perspective view illustrating an excavator assembly according to the present invention.
Figure 11:
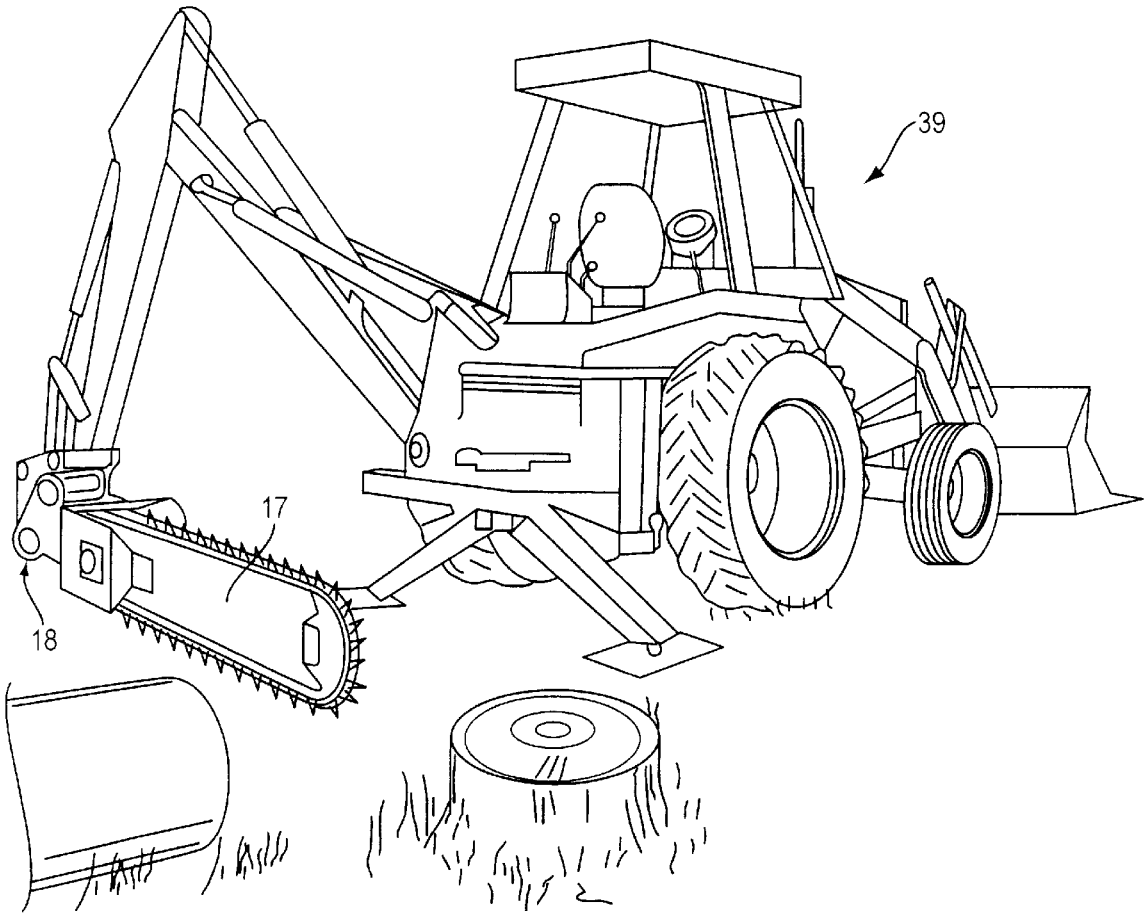

Referring to the drawings and initially to FIG. 1 there is illustrated an excavator assembly 10 including an excavator body having a pair of tracks 12 and 13, a cab 14, an articulated boom 15 and a trenching or cutting attachment 16 mounted at the end of the boom 15. The attachment 16 appears in FIG. 1, generally speaking as an enlarged chainsaw although this simplification is misleading as the whole assembly contributes to the control of and application of the cutting chain to different materials. The trenching or cutting attachment comprises a blade 17 mounted to a box-like drive mounting 18 with the box-like mounting 18 having on an opposite side thereof an excavator mounting means 19 so that the attachment can be detached from the excavator so that the excavator can be used with other attachments and does not remain idle when the cutting attachment is not in use. As can be seen in FIG. 11 the blade 17 is illustrated slightly swivelled out of the plane of the boom and this swivelling action will be described in more detail in FIGS. 4, 5A and 5B.

Figure 2A:
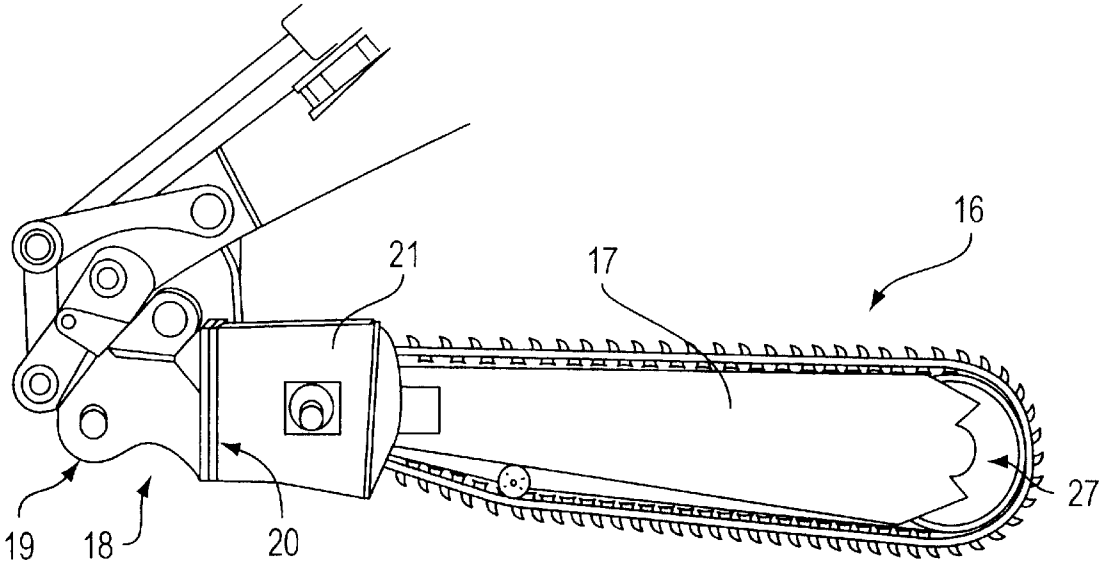
FIGS. 2A and 2B are opposite side views illustrating a trenching or cutting attachment according to the present invention.
Figure 2B:
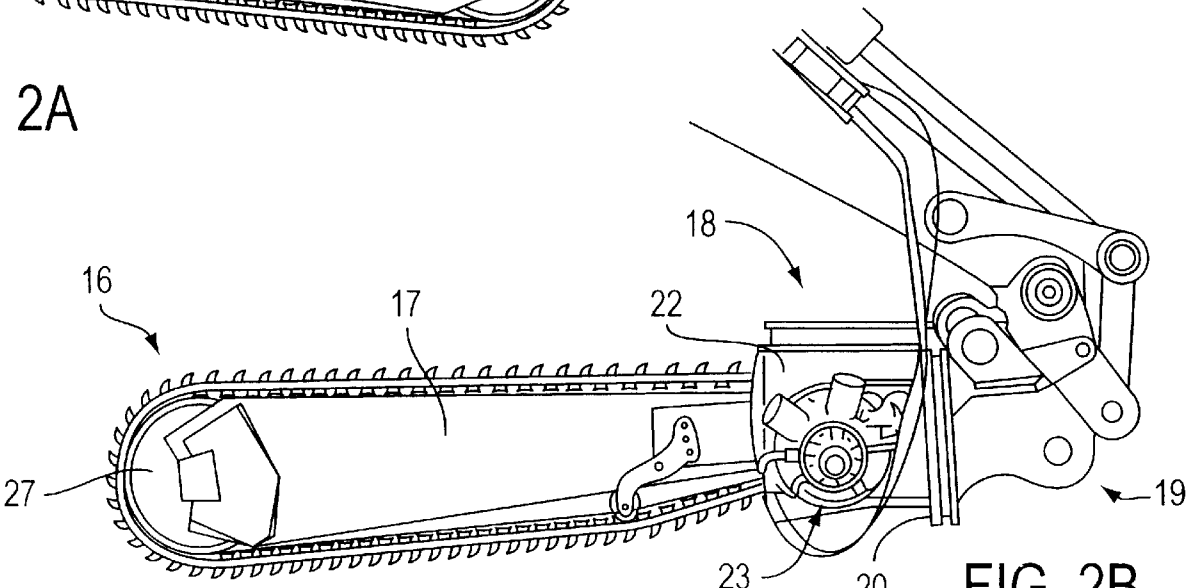
Figure 3:
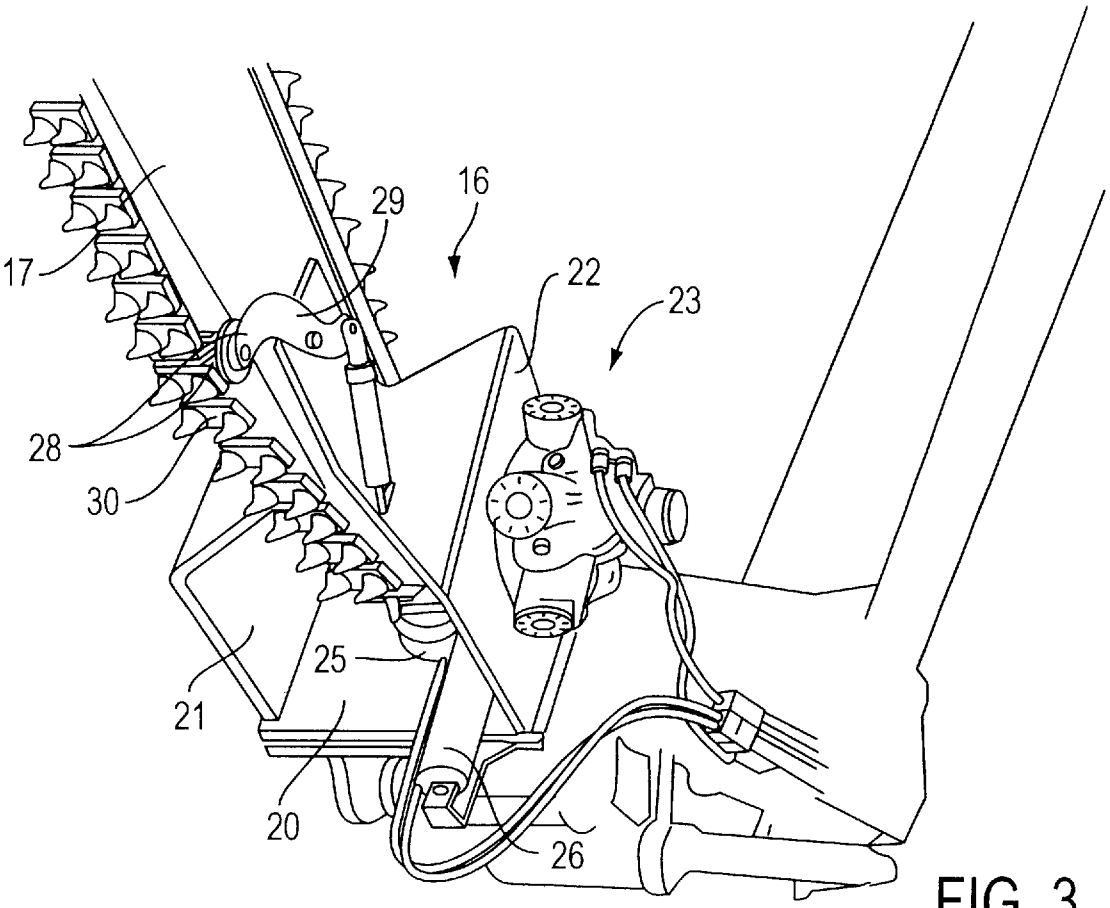
FIG. 3 is a part perspective view illustrating in greater detail a typical drive mounting of a trenching or cutting attachment for an excavator.

Referring to FIGS. 2A, 2B and 3 the attachment 16 is illustrated in more detail and where appropriate like numerals have been used to illustrate like features.

The mounting 18 comprises a backing plate 20 and a pair of side plates 21 and 22, a hydraulic motor 23 driven by the excavator hydraulics is mounted on the plate 22 and a shaft extends between the plates 21 and 22. On this shaft is mounted a sprocket wheel 24 (See FIG. 4). The backing plate 20 includes a bearing assembly 25 so that the plate 20 and the box-like drive mounting 18 and in turn the blade 17 can swivel. Typically this is accomplished utilising a double acting hydraulic cylinder assembly 26 mounted on projecting flanges so the double acting hydraulic cylinder assembly 26 itself is swivel mounted so that its mountings can travel through an arcuate path and thereby rotate the box-like drive mounting 18 about swivel 25 through angles of up to 90 degrees.

The blade 17 has an idler wheel at 27 as well as a chain tensioning wheel at 28 adjustably mounted to the blade by an arm 29, a pair of arms 29 (one of which can be seen in FIG. 3) can straddle the blade or a single arm 29 can be employed. A chain 30 travels over the sprocket wheel 24 and along the blade 17 around the idler 27 and the chain 30 will vary according to the application.

Figure 5A:
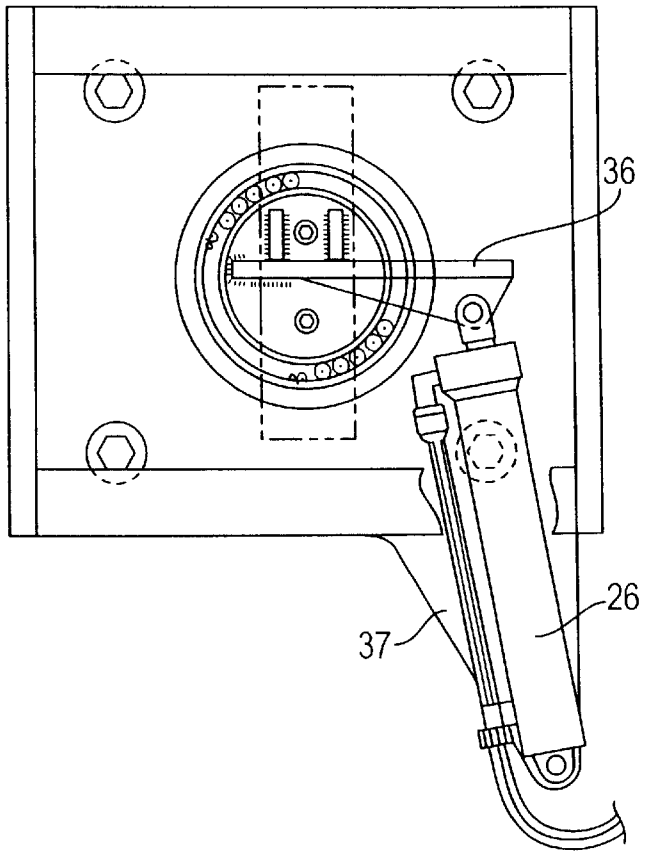
FIGS. 5A and 5B are views from inside the drive mounting showing two extreme positions of 90° swivel of a typical swivel mounting.
Figure 4:
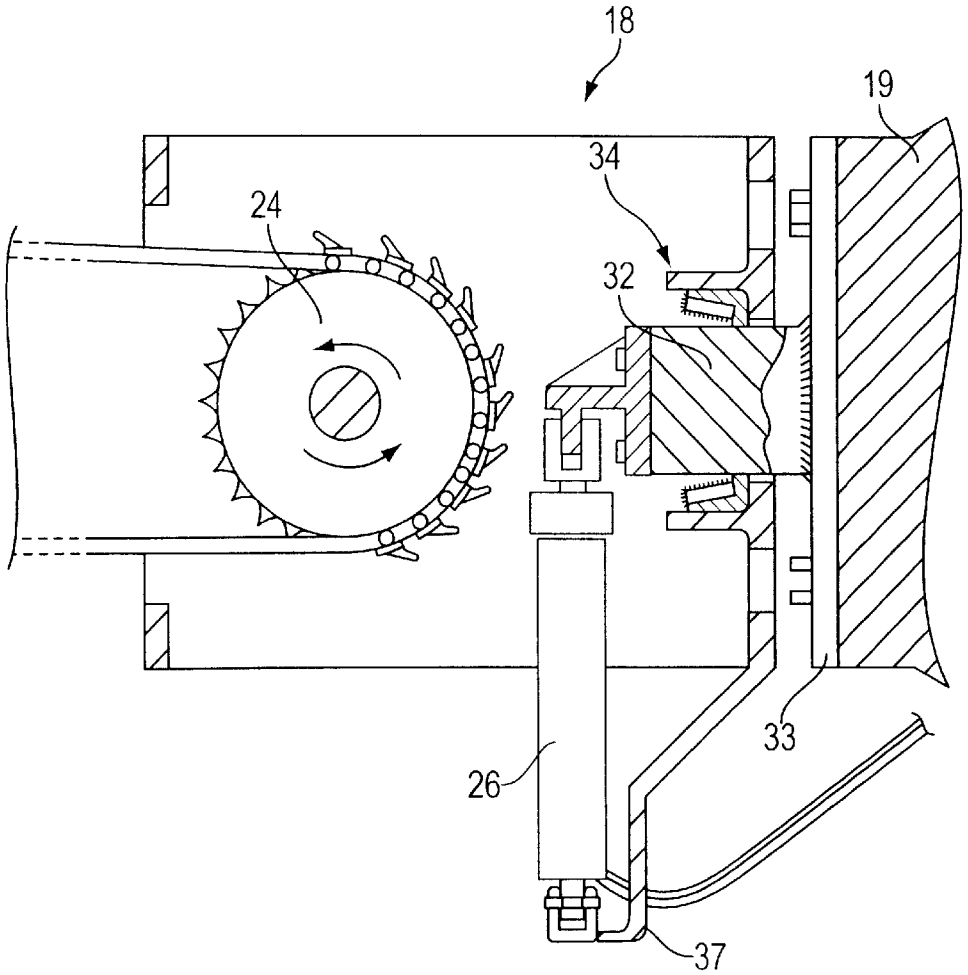
FIG. 4 is a section through the drive mounting of FIG. 3.
Figure 5B:
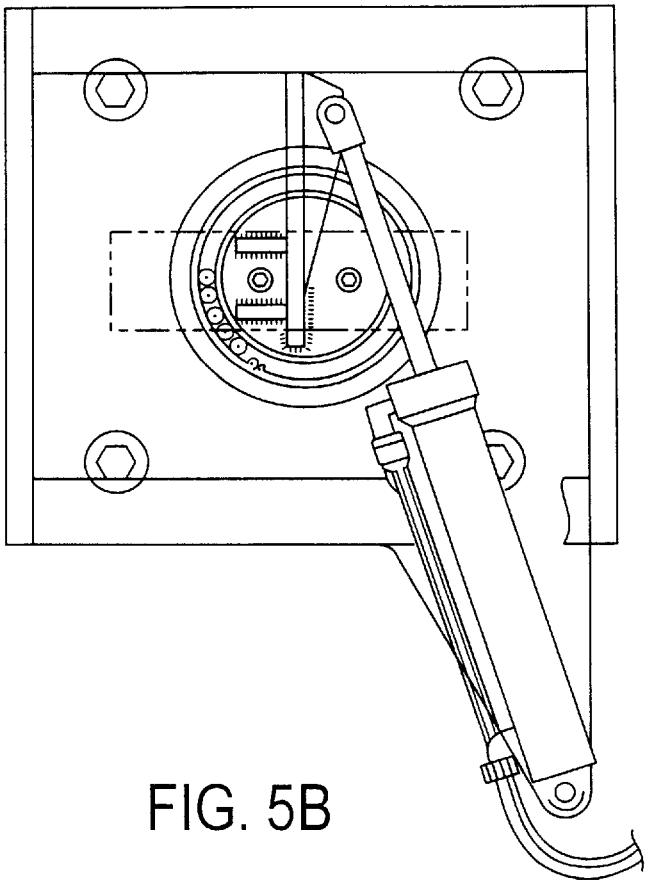

Referring to FIG. 4 there is illustrated section through the mounting 18 showing a section through the bearing assembly 25 where a sub 32 is welded to a plate 33 of the excavator mounting means 19 and protrudes through a bearing housing 34 holding a roller bearing 35, a crank arm 36 provides a mounting point for one end of the cylinder assembly 26 while the other end of the cylinder assembly is mounted to the flange mounting 37 so that upon extension of the arm the box 18 rotates around the stub 32 as illustrated in FIGS. 5A and 5B.

Figure 6:
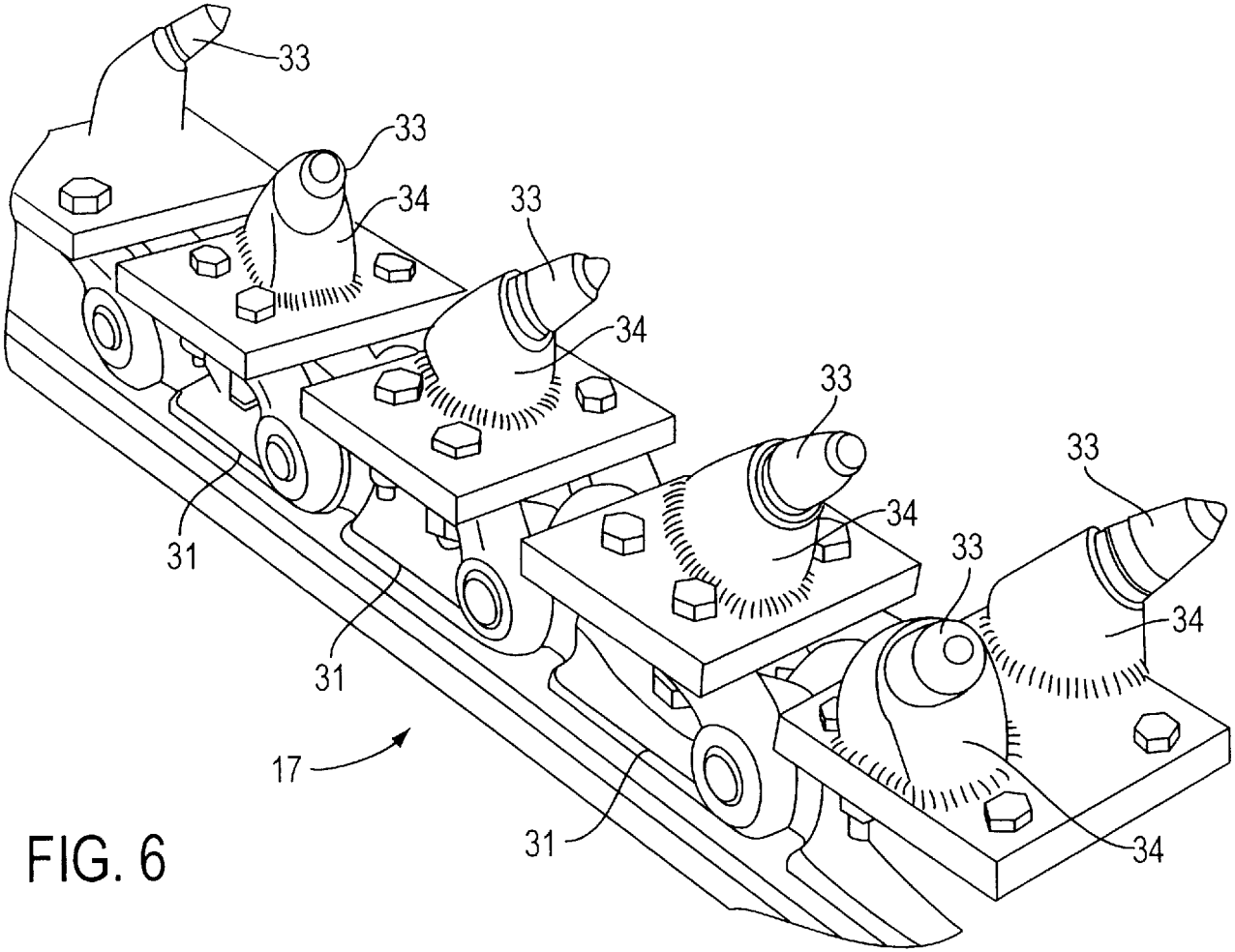
FIG. 6 is a perspective view illustrating a suitable chain for cutting sandstone.

FIG. 6 illustrates a typical chain 30 and in this case the chain 30 is typical of a chain utilised when using the present invention for cutting sandstone and in this case the chain employs a plurality of links 31 with each link 31 carrying two rotating cone shaped cutting points 33 mounted on fixed body portions 34.

Figure 7:
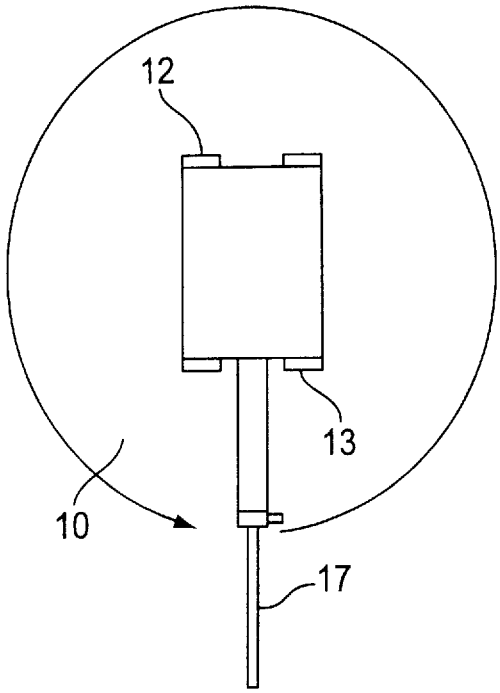
FIGS. 7 and 8 are schematic plan views illustrating the flexibility of an excavator assembly according to the present invention.
Figure 8:
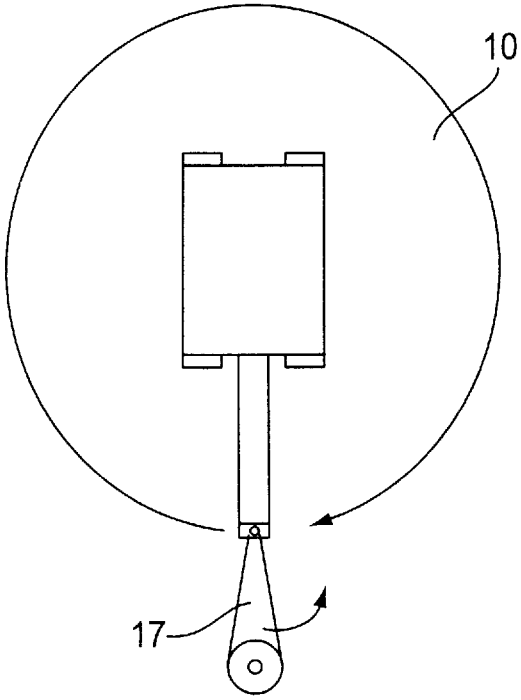

Referring to FIGS. 7 and 8 there is illustrated the flexibility of the excavator 10 when used as a cutter or trencher and as can be seen the excavator 10 according to normal operation, the body can rotate relative to the tracks 12 and 13 on its vertical axis through up to 360 degrees. This rotation is of course combined with the ability to swivel the blade 17 up to 90 degrees between the positions as illustrated in FIGS. 7 and 8. As well the boom can be used to retract the blade 17 and it will appreciated that the present invention has much greater flexibility than the prior art.

Figure 9:
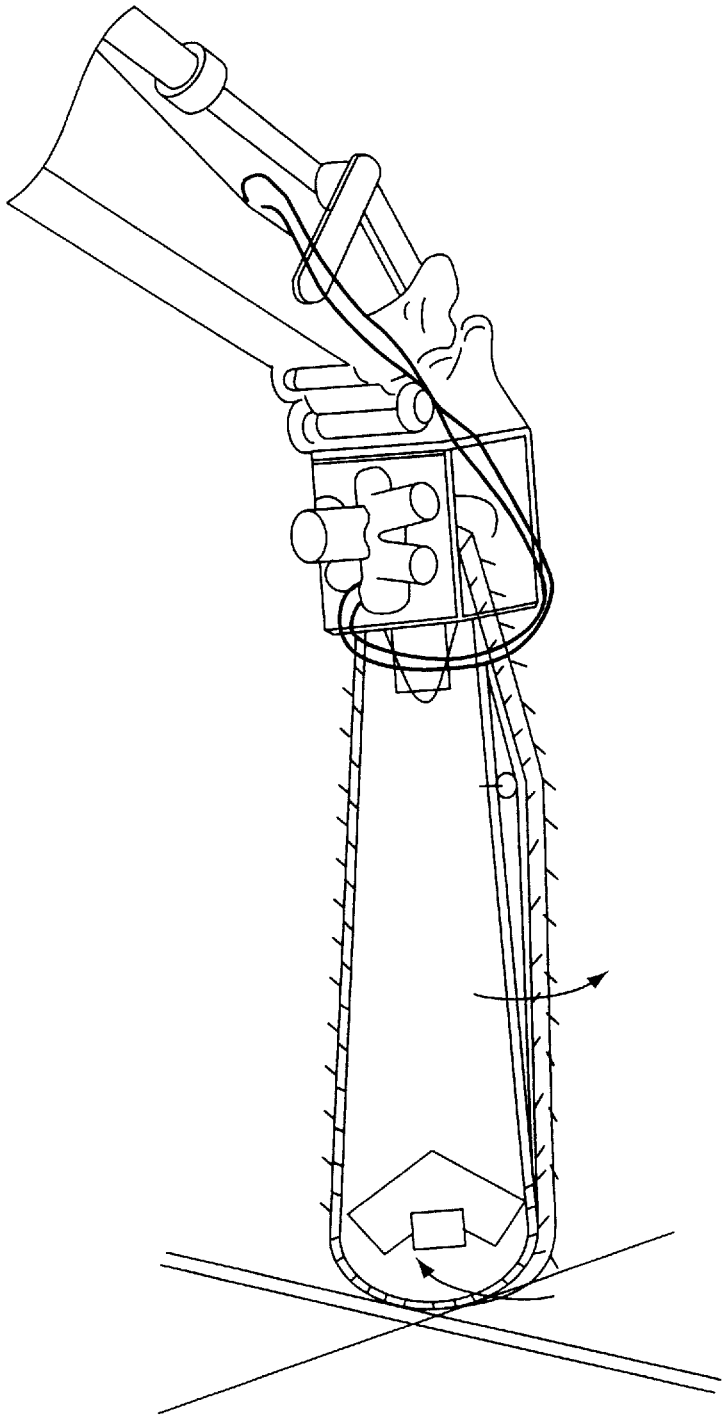
FIG. 9 is a part perspective view illustrating typical cutting positions of the blade.
Figure 10:
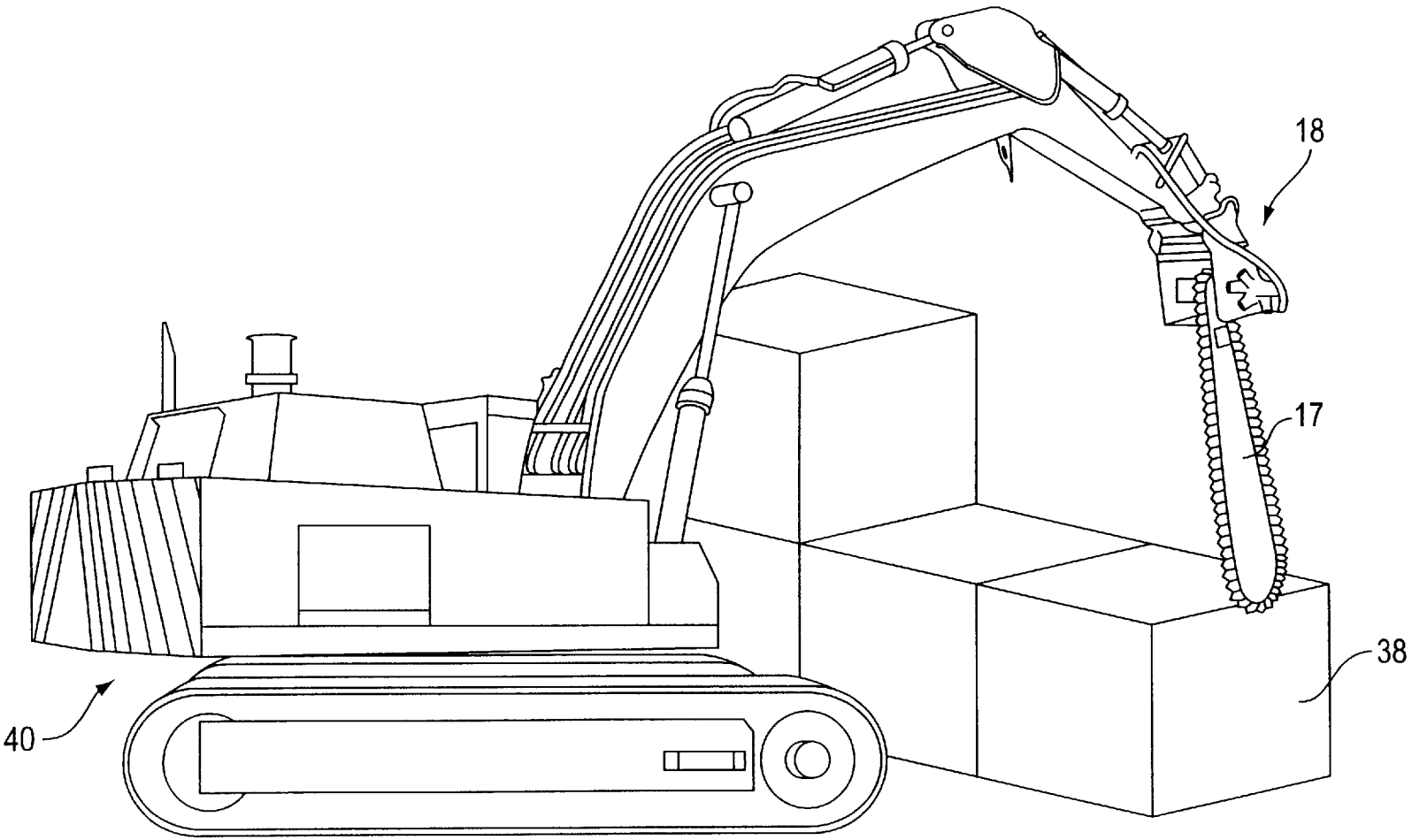
FIGS. 10 and 11 illustrate further applications of the present invention.

FIG. 9 illustrates a typical vertical cutting position of the blade 17 with the ability to make cuts at 90 degrees to each other; this means blocks of stone 38 can be cut out as shown in FIG. 10.

FIG. 11 illustrates another application in forestry where the blade employs a chain suited to cutting trees and is mounted on the boom of a backhoe 39 rather than the larger excavator of FIG. 11. The excavator of FIG. 1 on the other hand is a miniexcavator and the blade used in FIG. 1 is especially suited to trenching. The excavator 40 of FIG. 11 is a much larger machine suited to quarry work.

Whilst the above has been given by way of illustrative example of the present invention, many variations and modifications thereto will be apparent to those skilled in the art without departing from the broad ambit and scope of the invention as set forth in the appended claims.

We claim:

1. A cutting attachment for an excavator, the attachment having an excavator mounting means at a proximal end thereof, a drive mounting means adjacent to the excavator mounting means, a drive assembly having a hydraulic motor coupled to the drive mounting means, the excavator mounting means having secured thereto at an opposite side thereof the drive mounting means, the drive mounting means being configured as a pair of opposed projecting plates, each of the plates having an inside surface and an outside surface, the plates forming spaced flanges so that the excavator mounting means and drive mounting means form a substantially open box structure, the box structure having the hydraulic motor mounted on the outside surface of one of said plates, a drive shaft of the motor extending through said one plate and between the respective inside surfaces of the opposed plates and being journalled in bearings in each plate, the drive shaft carrying a sprocket wheel located between the plates, the drive mounting means having an elongate blade rigidly secured thereto, the blade projecting from a proximal end adjacent to the drive mounting means to a distal end remote from the drive mounting means, the blade having a peripheral edge and a longitudinal axis and tapering from the proximal end to the wider distal end of the blade, the distal end being rounded and wider than the proximal end, a cutting chain travelling around the peripheral edge of the blade, the blade having an idler wheel about which the chain travels, the idler wheel being located at the distal end of the blade opposite the drive assembly, the cutting arrangement having a swivel means so that the blade can swivel about the longitudinal axis of the blade, a double acting hydraulic cylinder assembly being employed to selectively swivel the blade and the cylinder assembly being mounted so that said cylinder assembly can travel through an arcuate path.

2. A cutting attachment according to claim 1 wherein the drive mounting means projects longitudinally and in line with the swivel mounting.

3. An excavator assembly configured as a cutting apparatus comprising an excavator slew body, and a cutting attachment coupled to the slew body, the attachment having an excavator mounting means at a proximal end thereof, a drive mounting means adjacent to the excavator mounting means, a drive assembly having a hydraulic motor coupled to the drive mounting means, the excavator mounting means having secured thereto at an opposite side thereof the drive mounting means, the drive mounting means being configured as a pair of opposed protecting plates, each of the plates having an inside surface and an outside surface, the plates forming spaced flanges so that the excavator mounting means and drive means form a substantially open box structure, the box structure having the hydraulic motor mounted on the outside surface of one of said plates, a drive shaft of the motor extending through said one plate and between the respective inside surfaces of the opposed plates and being journalled in bearings in each plate, the drive shaft carrying a sprocket wheel located between the plates, the drive mounting means having an elongate blade rigidly secured thereto, the blade projecting from a proximal end adjacent to the drive mounting means to a distal end remote from the drive mounting means, the blade having a peripheral edge and a longitudinal axis and tapering from the proximal end to the wider distal end of the blade, the distal end being rounded and wider than the proximal end, a cutting chain travelling around the peripheral edge of the blade, the blade having an idler wheel about which the chain travels, the idler wheel being located at the distal end of the blade opposite the drive assembly, the cutting arrangement having a swivel means so that the blade can swivel about the longitudinal axis of the blade, a double acting hydraulic cylinder assembly being employed to selectively swivel the blade, and the cylinder assembly being mounted so that said cylinder assembly can travel through an arcuate path.

4. An excavator assembly according to claim 3 configured for cutting sandstone, the blade being 3 m–4 m long and the chain having a plurality of self cleaning rotating cone teeth on about a 120 mm wide chain and between 25 ton to 40 ton in capacity.

5. An excavator assembly according to claim 3 wherein the blade is coupled to the slew body by an articulated boom for operation involving selectively from a projecting generally horizontal extension to a retracted tucked away transport position opposite the extended position.

6. An excavator assembly according to claim 5 wherein the blade can be held with the longitudinal axis extending vertically down from the excavator and in the same position swivelled about a vertical axis.

7. An excavator assembly according to claim 3 wherein the cutting attachment is directly coupled to the slew body.

8. An excavator assembly according to claim 3 wherein the cutting attachment is coupled to the slew body via an articulated boom or a part thereof.

9. An excavator assembly according to claim 3 wherein the slew body is rotatable about a vertical axis up to 360°.

* * * * *